US011761313B2

(12) United States Patent
Pearson

(10) Patent No.: US 11,761,313 B2
(45) Date of Patent: Sep. 19, 2023

(54) ONE-CLICK CONTACT DETONATOR FOR PERFORATING GUN SYSTEM

(71) Applicant: GEODYNAMICS, INC., Millsap, TX (US)

(72) Inventor: Jarrod Henry Pearson, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/467,544

(22) Filed: Sep. 7, 2021

(65) Prior Publication Data

US 2022/0251931 A1 Aug. 11, 2022

Related U.S. Application Data

(60) Provisional application No. 63/148,380, filed on Feb. 11, 2021.

(51) Int. Cl.

| | |
|---|---|
| ***E21B 43/1185*** | (2006.01) |
| ***F42D 1/05*** | (2006.01) |
| *E21B 43/117* | (2006.01) |

(52) U.S. Cl.
CPC ..... *E21B 43/1185* (2013.01); *F42D 1/05* (2013.01); *E21B 43/117* (2013.01)

(58) Field of Classification Search
USPC ..... 102/310
See application file for complete search history.

(56) References Cited

U.S. PATENT DOCUMENTS

| | | | |
|---|---|---|---|
| 9,581,422 | B2 | 2/2017 | Preiss et al. |
| 10,844,696 | B2 | 11/2020 | Eitschberger et al. |

*Primary Examiner* — Reginald S Tillman, Jr.
(74) *Attorney, Agent, or Firm* — Morgan, Lewis & Bockius LLP

(57) ABSTRACT

A detonator for initiating a firing of a shaped charge in a gun is configured to include a housing having first and third conducting portions and a second insulating portion, which is sandwiched between the first and third conducting portions; an initiator located fully inside the first conducting portion or the third conducting portion; a first electrical line electrically connecting the initiator to an internal wall of the third conducting portion; and a second electrical line electrically extending from the initiator to the first conducting portion, through the entire second insulating portion.

19 Claims, 20 Drawing Sheets

ONE-CLICK CONTACT DETONATOR FOR PERFORATING GUN SYSTEM

BACKGROUND

Technical Field

Embodiments of the subject matter disclosed herein generally relate to downhole tools for oil and gas operations, and more specifically, to a detonator for a perforating gun that is electrically connected to one or more electrical contacts without splices, by a one-click action.

Discussion of the Background

During the preparation of an oil field, a well 100 is drilled to a desired depth H relative to the surface 110, as illustrated in FIG. 1, and a casing 110 protecting the wellbore 104 is installed and cemented in place. The well can be vertical or horizontal. To connect the wellbore 104 to the subterranean formation 106 to extract the oil and/or gas involves a gun system that has plural perorating guns connected to each other by corresponding tandem subs and each perforating gun has a corresponding detonator and one or more shaped charges.

The process of connecting the wellbore to the subterranean formation may include the following steps: (1) placing a plug 112 (known as a frac plug) above a just stimulated stage, (2) lowering a perforating gun system 120 into a new stage 118, above the already stimulated stage, and (3) perforating the new stage 116 above the plug 112. The gun system 120 is lowered into the wellbore 104 with a wireline 122. A controller 124 located at the surface controls the depth of the wireline 122 in the well and also sends various commands along the wireline to actuate one or more perforating guns of the gun system.

A traditional gun system 120 includes plural guns 126 connected to each other by corresponding subs 128, as illustrated in FIG. 1. A detonator 130 and a corresponding switch 132 may be located in a single detonator unit 134 and placed next or within each gun 126. The detonator 130 is typically connected through one or more wires to the wireline 122. In some instances, the switch 132 is electrically connected between the detonator 130 and the wireline 122 to control the activation of the detonator 130. The corresponding switch 132 may be actuated by the detonation of a downstream gun or by the controller 124. When this happens, the detonator 130 becomes electrically connected to the wireline, and when a command from the surface actuates the detonator 130, the corresponding perforating gun is fired.

For a conventional perforating gun system 120, the casings of the guns 126 are first loaded with shaped charges and a corresponding detonator cord. Then, the controller 132 and the detonator 130 are electrically connected to various lines that extend from the wireline, manually, by the operator of the gun system. The guns are thus built up, one gun at a time, by connecting the detonators and switches, through the corresponding subs 128, to the wireline. Those skilled in the field know that this assembly operation has its own risks, i.e., miswiring, which may render one or more of the switches and corresponding detonators unusable. Also, this operation may result in the accidental firing of the shaped charges while the detonator is being attached to the switch, which endangers the life of the operator.

To avoid the problem of connecting the wrong wires of the wireline to the controller 132 or detonator 130, U.S. Pat. No. 9,581,422 discloses a wireless detonator assembly, which is shown in FIG. 2, and corresponds to FIG. 3 of the patent. The wireless detonator assembly 10 has a shell 12, also called a housing or a casing, made of a metal. The shell 12 is configured to extend along a longitudinal axis X. The detonator assembly 10 further has a detonator head 18 that extends transversally from the shell 12, along a perpendicular axis Y. The detonator head 18 has a line-in portion 20, and a line-out portion 22, which are electrically separated from each other by an insulator 24. In one application, the detonator shell 12 is configured as a ground portion 13.

This configuration simplifies the connection of the detonator assembly to the gun as no wires need to be manually handled for achieving the electrical connections to the wire line. However, the wireless connections to be achieved by the detonator assembly 10 with a mating assembly 40 require good electrical connections, which are achieved by three dedicated electrical contacts 12', 20', and 22', as shown in FIG. 3. This means that the mechanical contact between the electrical portions 12, 20 and 22 of the detonator assembly 10 and the corresponding electrical contacts 12', 20' and 22' of the mating assembly 40 must be perfect, i.e., the tolerance between the mechanical components that make up the mating assembly and the detonator assembly should be extremely accurate or otherwise no electrical contacts are achieved between one or more pairs of these electrodes. Given that the detonator assembly 10 is designed to slide into a corresponding bore 42 of the mating assembly 40, there is always a small gap G between the outside of the shell 12 and the bore 42. This gap may also be present between the electrode 22 and the electrical contact 22'. Such a gap would suppress the electrical connection between the detonator assembly and the mating assembly, which would result in a misfire of the detonator. The potential for misfiring the detonator assembly is exacerbated by the fact that the entire gun system experiences some violent shocks when lowered into the well or when a gun is fired. Thus, there is a concern that the configuration of the detonator assembly 10 might fail electrically under certain conditions by failing to make all three required electrical contacts discussed above.

Thus, there is a need to provide another detonator system that has the advantage of connecting in a wireless manner to a gun system, but also ensuring that the electrical contacts cannot be separated during normal operation conditions inside the well.

SUMMARY

According to an embodiment, there is a detonator for initiating a firing of a shaped charge in a gun. The detonator includes a housing having first and third conducting portions and a second insulating portion, which is sandwiched between the first and third conducting portions, an initiator located fully inside the first conducting portion or the third conducting portion, a first electrical line electrically connecting the initiator to an internal wall of the third conducting portion, and a second electrical line electrically extending from the initiator to the first conducting portion, through the entire second insulating portion.

According to another embodiment, there is a detonator assembly for initiating a firing of a shaped charge in a gun. The detonator assembly includes a shell, a board located within the shell, a one-click connecting mechanism attached to the board, a detonator attached to the connecting mechanism with no wires, and a switch located on the board. The connecting mechanism is configured to removably receive the detonator. The connecting mechanism establishes electrical connections between the detonator and the board.

According to another embodiment, there is a gun system for perforating a well, and the gun system includes a gun having one or more shaped charges, a detonator having a length L and configured to fire the one or more shaped charges, and a receiving mechanism having a bore that is configured to receive the detonator. The detonator is shaped as a cylinder having a unique radius R along the entire length L.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a spliceless detonator that is attached to a perforating gun by a one-click action, with no wires. However, the embodiments discussed herein are also applicable to a detonator that attaches to a sub or a setting tool or to a detonator that includes a switch and attaches to a gun, sub or setting tool with no wires.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 4:
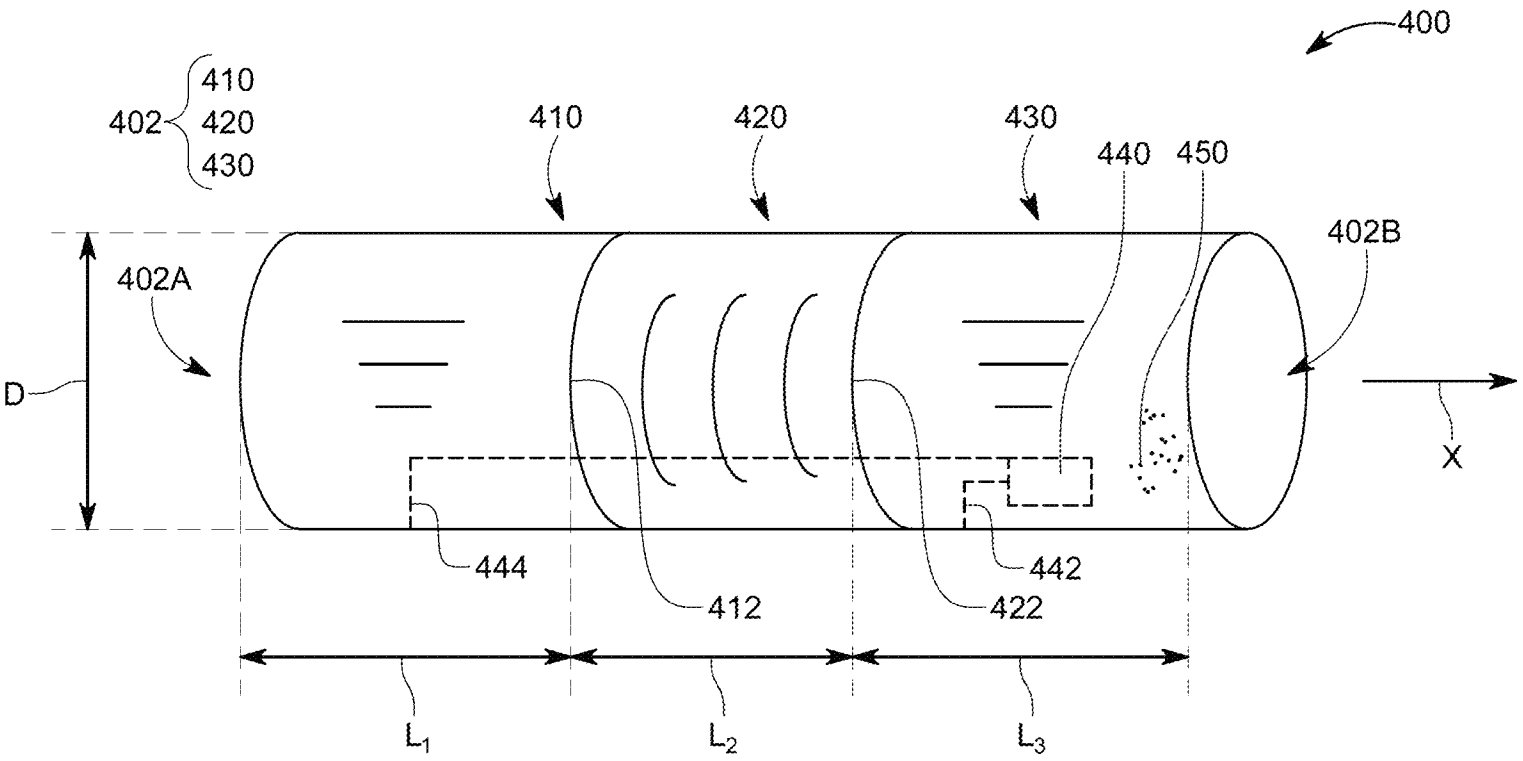
FIG. 4 illustrates a one-click contact detonator that achieves mechanical and electrical connections with a host without splicing.

According to an embodiment illustrated in FIG. 4, a novel detonator 400 has a casing 402 that extends along a longitudinal axis X. The casing 402 has no external wires, no external protrusions, no external pad, or no external extensions. In one application, the casing 402 is a perfect cylinder having two end sides 402A and 402B that have identical sizes and shapes. The casing has the head and tail having a same size and shape as the body of the casing (i.e., the part between the head and the tail). In one application, the casing is shaped to have one end smaller in diameter than the other end. In another application, the casing 402 is smooth, uniform, and has a constant diameter D at any location along the longitudinal axis X.

In the embodiment shown in FIG. 4, the casing 402 is made of three distinct portions 410, 420 and 430. The casing can have more than three portions as discussed later. The first portion 410 is made of a conducting material, e.g., a metal. The second portion 420 is made of an insulator material, for example, a plastic. The third portion 430 is made of a conducting material, the same as the first portion 410 or different. Thus, the three portions are visible by the bare eye to be distinct, although they are part of the same constant and smooth cylindrical case. The three portions 410, 420, and 430 are connected to each other forming two interfaces 412 and 422. A first length L1 of the first portion 410, a second length L2 of the second portion 420, and a third length L3 of the third portion 430 can have any values. In one application, the three portions are equal in length, i.e., L1=L2=L3. However, in another application, only the first and third portions are equal in length. In yet another application, no two lengths are equal. To offer the operator of the gun system an indicia about which end of the casing should be inserted first into a gun or a sub, two or more of the portions may be color coded or one or more arrows and associated warnings may be printed on the portions.

In this embodiment, an initiator 440 is placed within the third portion 430, next to an explosive load 450. The initiator and the explosive load may alternately be placed in the first portion with similar effects. If the first or third portions have a very short length, the initiator may even be placed in the second portion and part or all of the explosive material may be placed in the shortest of the first and third portions. In one embodiment, it is even possible to have the explosive material extend into the second portion. The initiator 440 is configured to detonate the explosive load 450. To achieve this result, the initiator 440 is connected in this embodiment to two electrical lines 442 and 444. The first electrical line 442 is electrically connected to an interior of the third portion 430 while the second electrical line 444 is electrically connected to an interior of the first portion 410, i.e., to the two metallic parts of the casing. The second electrical line 444 extends through the third portion, 430, the entire second portion 420, and partially into the first portion 410. While the two electrical lines 442 and 444 are shown in FIG. 4 being electrically connected to the side of the third and first portions 430 and 410, respectively, the two electrically lines can also be directly connected to the end sides 402A and 402B, respectively, or to a combination of a side wall and an end side of the first and third portions. While FIG. 4 shows the casing 402 being made of two metal portions separated by an insulating portion, it is possible to made the casing of three metal portions and two insulating portions, or any other number of such portions as long as each conducting portion is followed by an insulating portion and vice versa.

Figure 5:
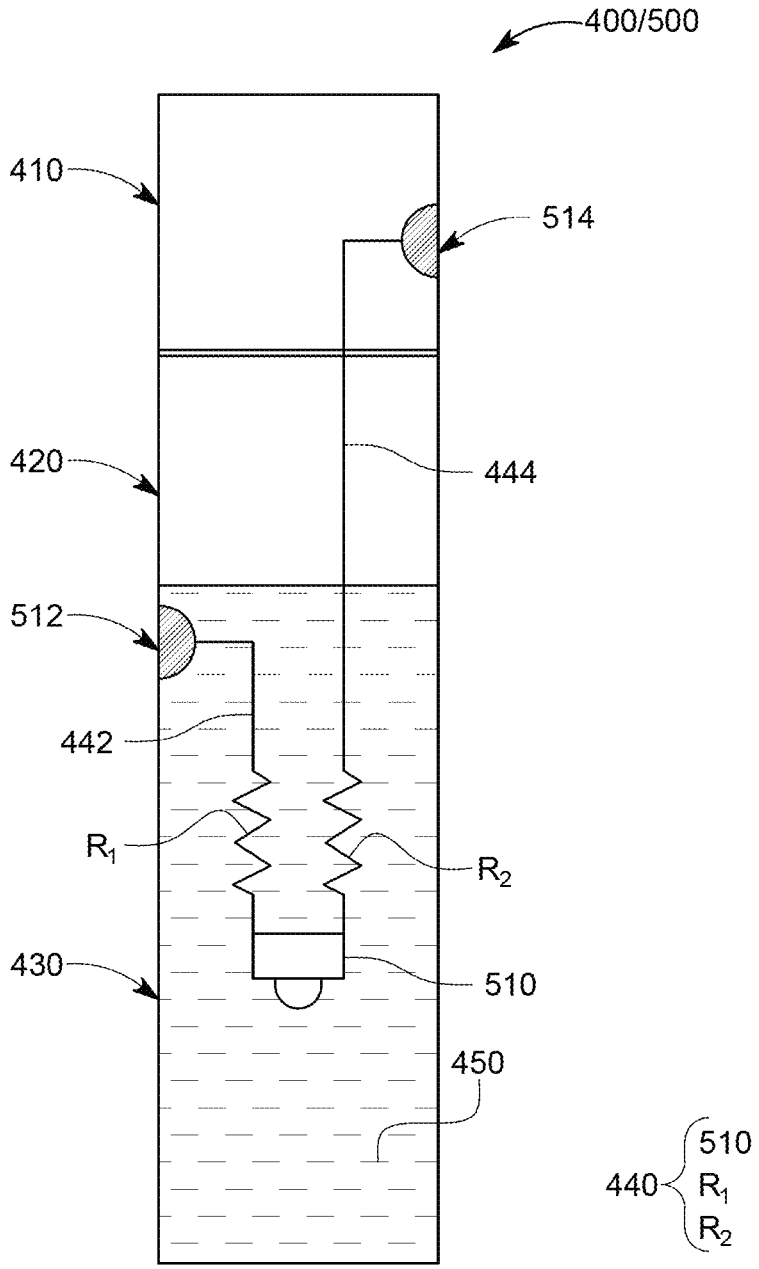
FIG. 5 shows an implementation of the one-click contact detonator.
Figure 6:
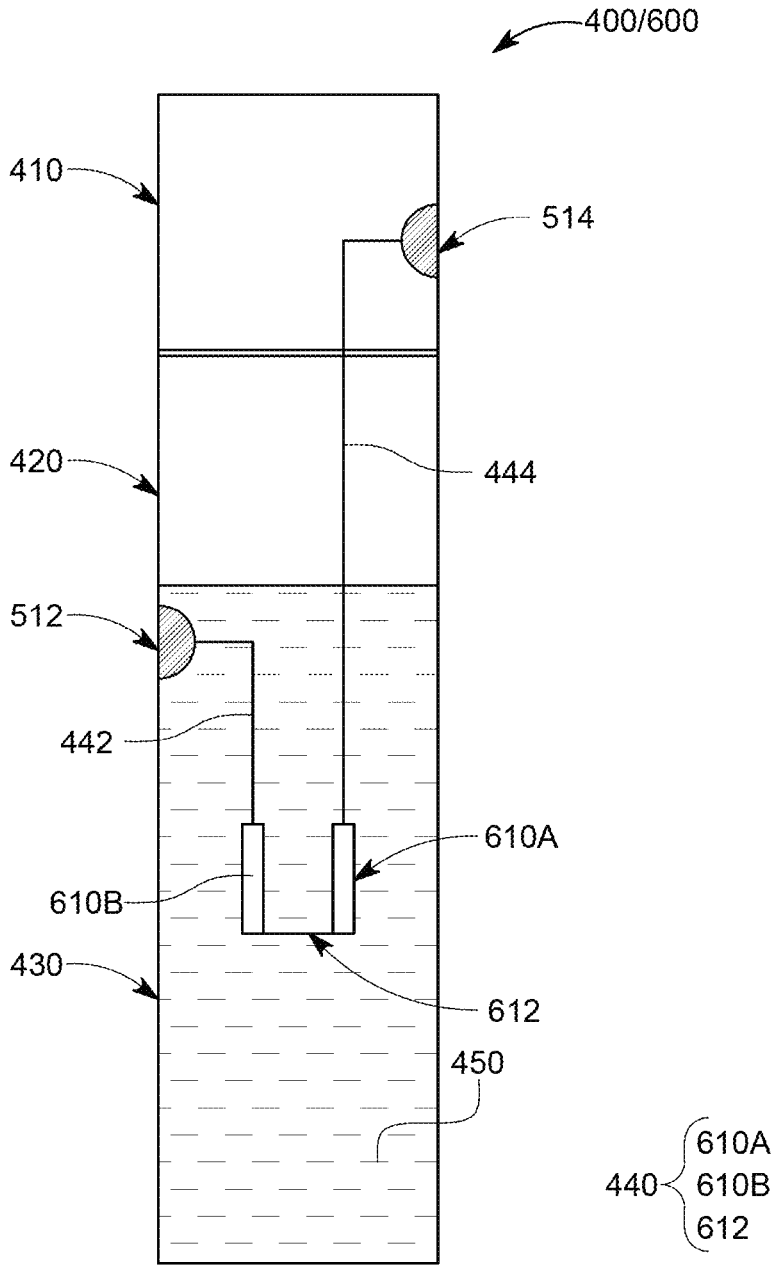
FIG. 6 shows another implementation of the one-click contact detonator.

FIG. 5 illustrates an implementation 500 of the detonator 400 that has the first conductive portion 410, the second insulating portion 420, and the third conductive portion 430, connected in this order to each other. The initiator 440 is implemented in the third portion 430, as a fuse head 510 electrically connected in series between two resistors R1 and R2. The first resistor R1 is connected to the first electrical line 442 and the second resistor R2 is connected to the second electrical line 444. The two resistors may be 27 ohm resistors. The first electrical line 442 makes an electrical contact 512 with the interior wall of the third portion 430 while the second electrical line 444 makes an electrical contact 514 with the interior wall of the first portion 410. FIG. 5 also shows the explosive load 450 provided inside the third portion 430 and distributed around the initiator 440. The initiator 440 may also be implemented as a combination of two electrodes 610A and 610B connected by a gold bridge wire 612, as illustrated by the implementation 600 in FIG. 6. When current is provided through the electrical lines 442 and 444, the resistors R1 and R2 and the fuse head 510 in FIG. 5 and the gold line 612 in FIG. 6 become very hot, igniting the explosive load 450.

Figure 7A:
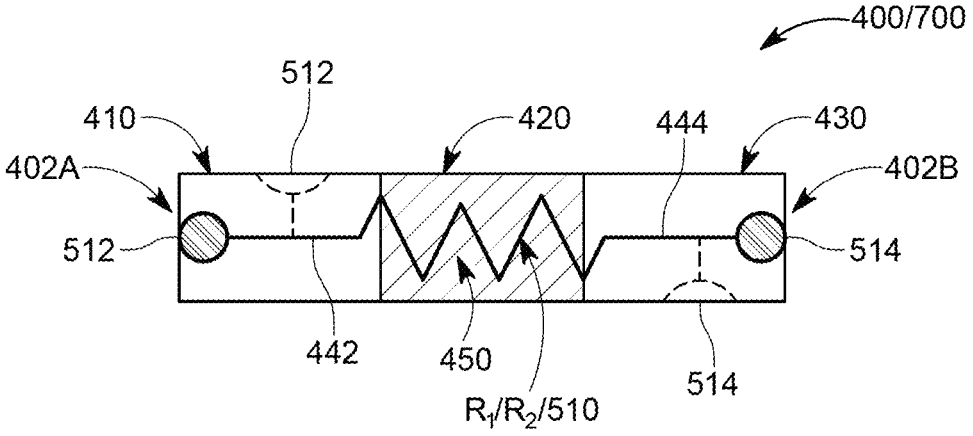
FIGS. 7A and 7B show yet another implementation of the one-click contact detonator.
Figure 7B:
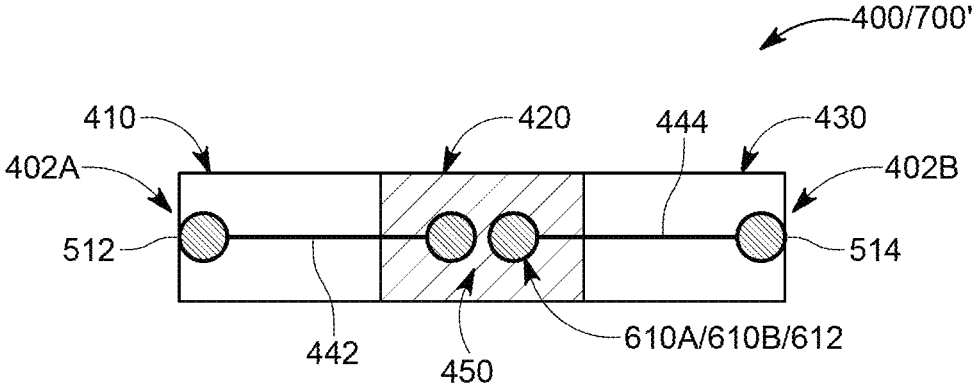

While the previous embodiments disclose the explosive load 450 being located in the third portion 430, it is also possible that the explosive load is located in the second portion 420, as illustrated in FIGS. 7A and 7B. FIG. 7A shows an implementation 700 of the detonator 400 which has the two resistors R1 and R2 and the fuse head 510 placed together with the explosive load 450 within the second portion 420. For this arrangement, the first electrical line 442 extends through the first portion 410 to the electrical contact 512, which is placed on the end face 402A of the casing 402, while the second electrical line 444 extends through the third portion 440 to the electrical contact 514, which is placed on the opposite end face 402B of the casing 402. Note that in this embodiment, the explosive load 450 can be placed in its entirety within the second portion 420, the first electrical line 442 extends only through the first portion 410 and the second electrical line 444 extends only through the third portion 430. In one application, one or both electrical contacts 512 and 514 may be located on the side walls of the first and third portions, respectively. FIG. 7B shows a similar implementation 700', but having the detonator structure shown in FIG. 6.

Figure 1:
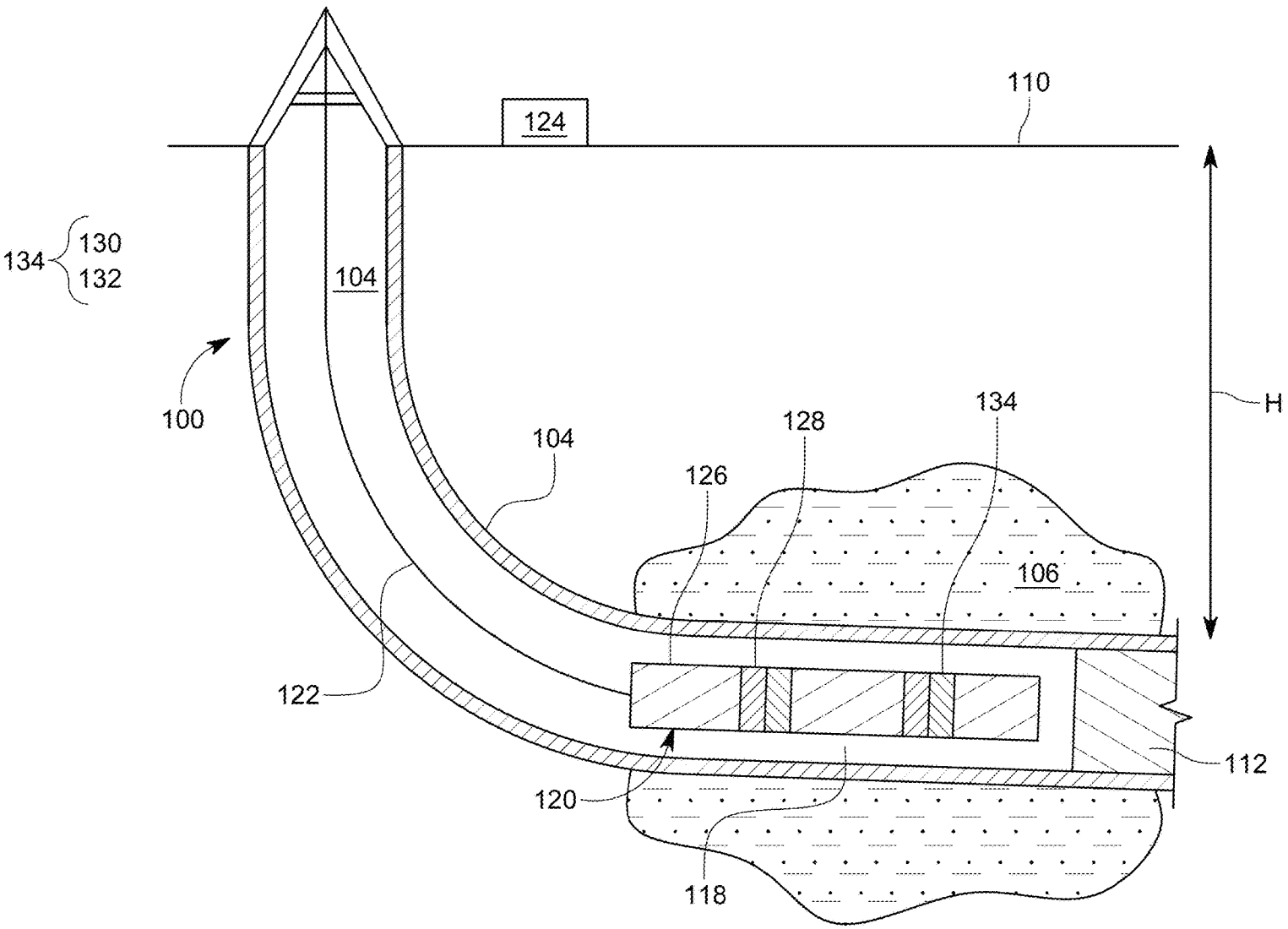
FIG. 1 illustrates a well and associated equipment for well completion operations.
Figure 2:
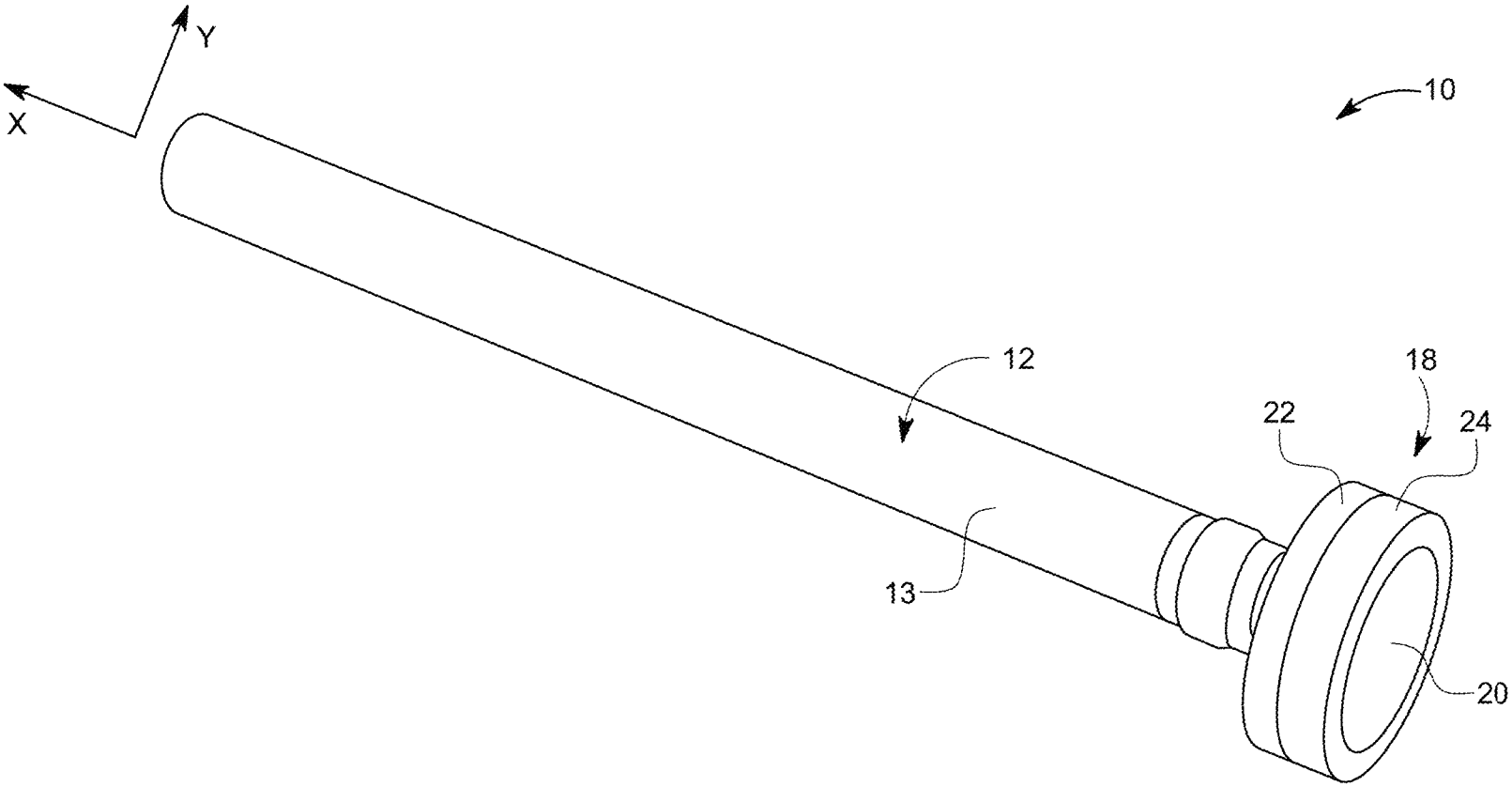
FIG. 2 illustrates a wireless detonator that is configured to slide inside a perforating gun.
Figure 3:
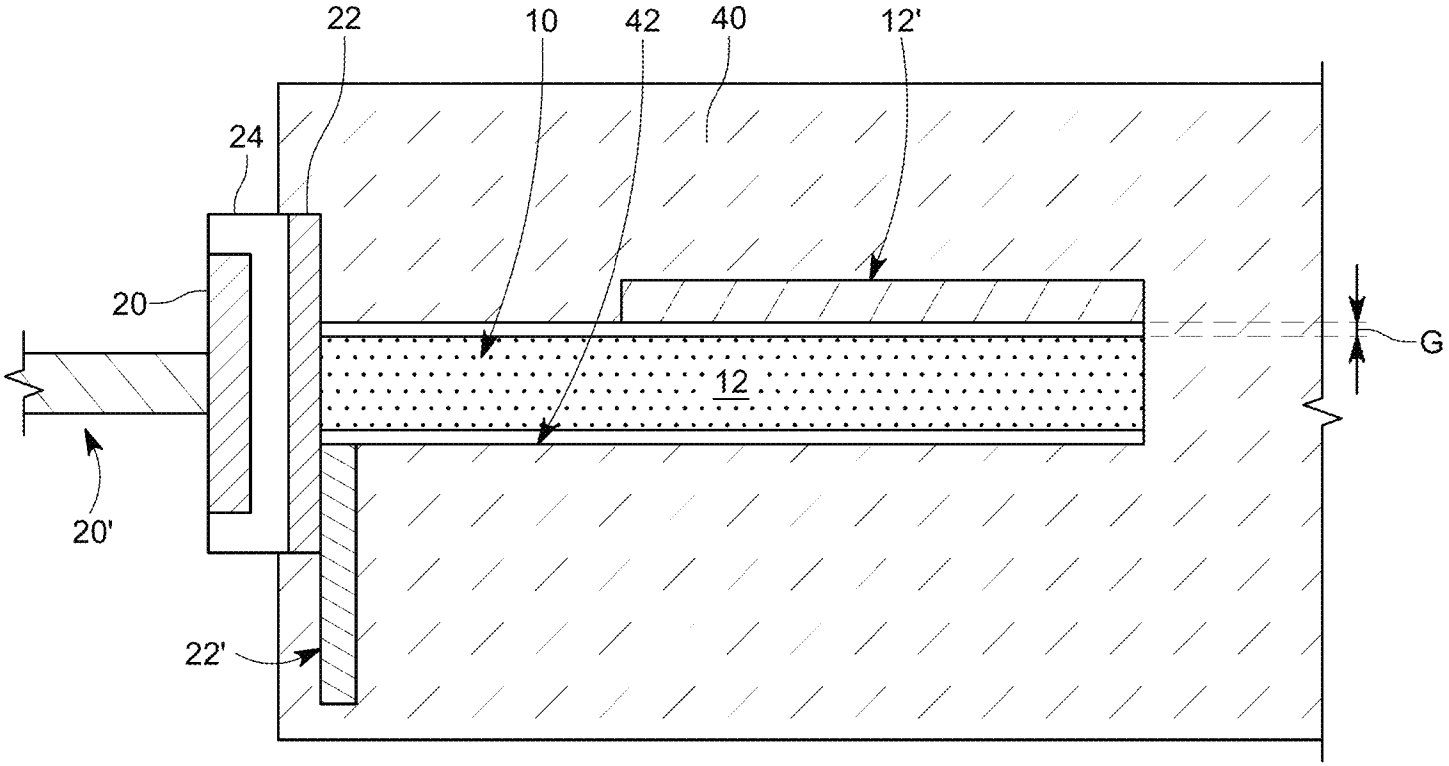
FIG. 3 illustrates the wireless detonator of FIG. 2 being attached to an inside of a perforating gun.
Figure 8:
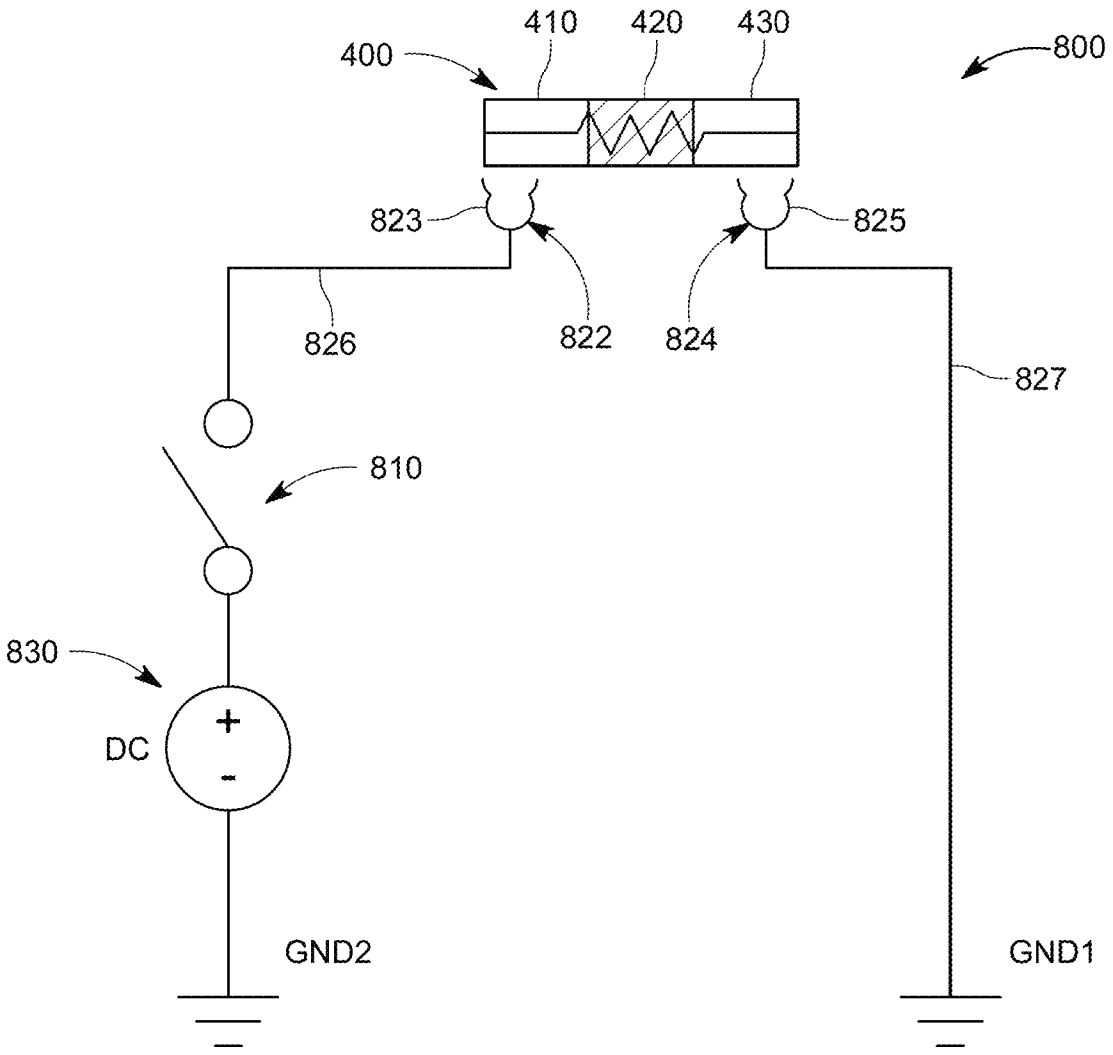
FIG. 8 schematically illustrates the electrical connections between the one-click contact detonator and a switch.

It is noted that the various implementations illustrated in FIGS. 5 to 7B do not include, inside the casing 402, a switch, a printed circuit board, or other electronics for controlling the activation of the initiator 440. For these implementations the switch is located outside the casing 402 as now discussed with regard to FIG. 8. FIG. 8 shows the detonator 400 being electrically connected to an external switch 810, thus forming a controllable detonator 800. The detonator 400 (any previously shown implementation can be used) is mechanically attached with the first conductive portion 410 to a first clip 822, and with the third conductive portion 430 to a second clip 824. The first and second clips can form a connecting mechanism 820. Thus, the detonator 400 can be attached to the connecting mechanism 820 with a one-click action, as no external wires are required to be spliced. The one-click action achieves simultaneously both a mechanical and an electrical connection between the detonator and the connecting mechanism. The mechanical connection is tight, and does not rely on the manufacturing accuracy of the components. Thus, the risk of having an electrical disconnect between the detonator and the connecting mechanism when the gun system experiences shocks in the well is effectively removed, overcoming the deficiencies of the detonator shown in FIG. 2. Also the positioning of the detonator relative to the connection mechanism is more forgiving as long as each clip contacts the first or third portions. Note that the existing detonators need an elaborate mating device for exactly contacting the electrical regions of the detonator.

The first and second clips 822 and 824 are made of a conductive metal and they include a corresponding elastic part 823 and 825, respectively. The elastic parts 823 and 825 are configured to press tightly on the casing 402 so establish an intimate contact with the casing. Thus, no matter the shocks exerted on the controllable detonator 800, there is no danger of losing the electrical contact between the detonator 400 and the switch 810.

Each of the first and second clips 822 and 824 are connected to corresponding electrical leads 826 and 827, respectively. The switch 810 can be electrically connected to a power source 830, for example, a DC power source. The power source 830 and the second clip 824 can be grounded to the same or different grounds GND1 and GND2. For example, if the power source 830 is located at the head of the well, the power source is grounded to the surface while the second clip is grounded to the casing of the gun system.

Figure 9:
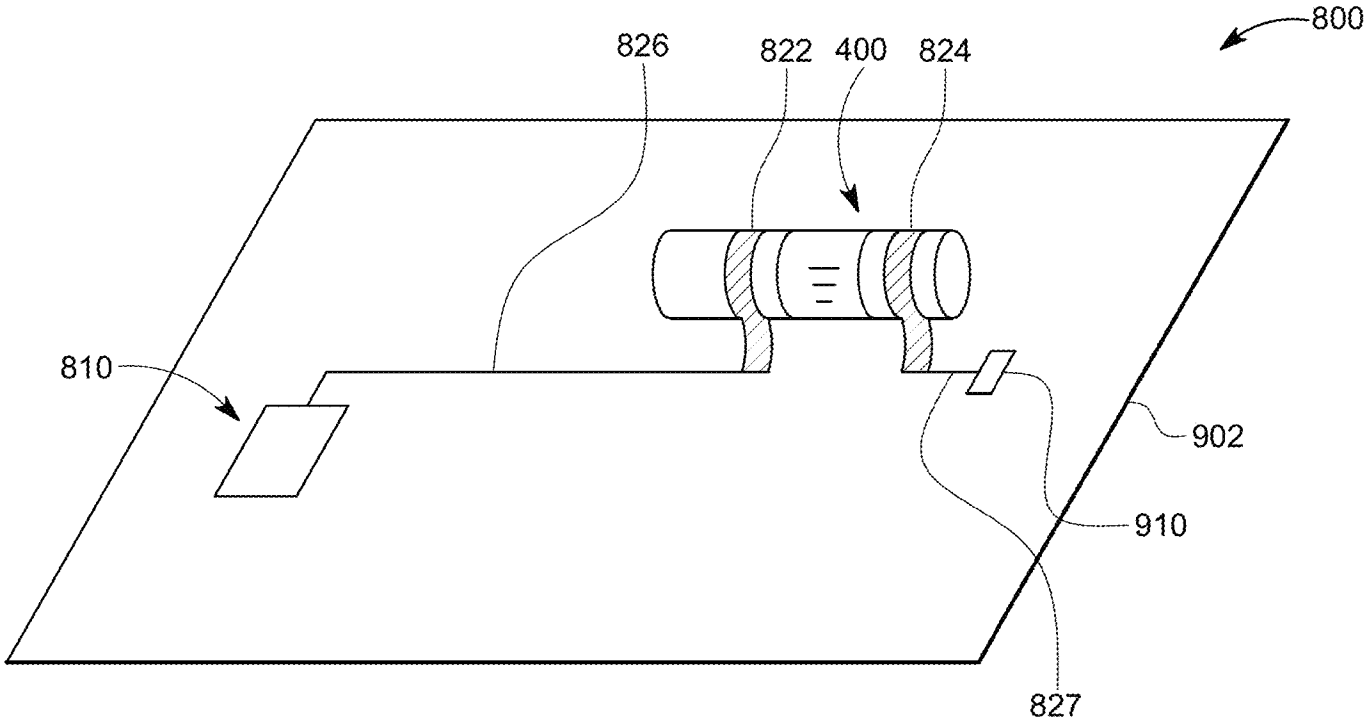
FIG. 9 schematically illustrates the electrical connections between the one-click contact detonator and a printed circuit board.

In one embodiment, as illustrated in FIG. 9, the two clips 822 and 824 are mechanically attached to a printed circuit board 902. The switch 810 may be implemented as an integrated circuit that is also positioned on the board 902. The switch may be configured to have an address, so that it is addressable. The figure shows that the electrical leads 826 and 827 may be part of the printed circuit board 902. The second electrical lead 827 may extend to a pad or pin 910 that is configured to be grounded. The embodiment illustrated in FIG. 9 shows the detonator 400 being attached to printed circuit board mounted clips 822 and 824. However, it is possible to attach the detonator 400 in other ways to the printed circuit board 902 or to another medium.

Figure 10A:
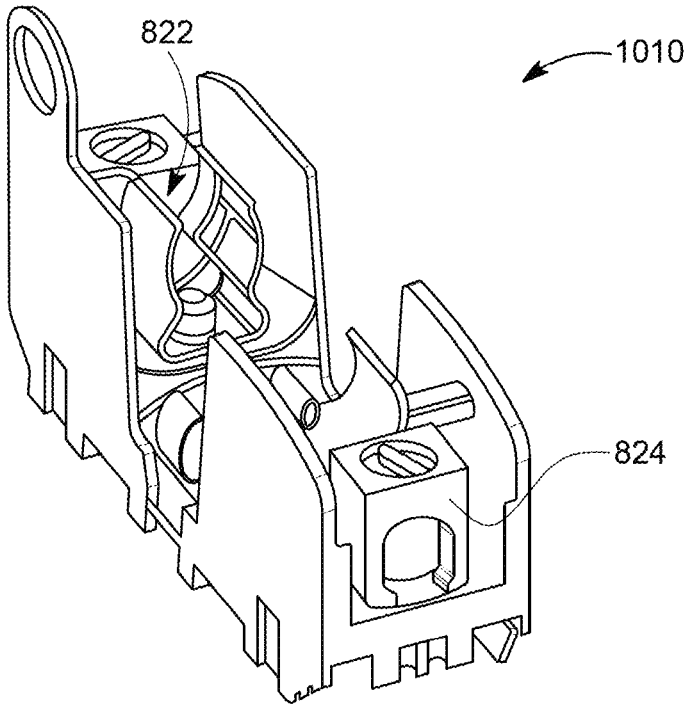
FIGS. 10A to 10D illustrate possible mechanisms for attaching the one-click contact detonator to a board.
Figure 10B:
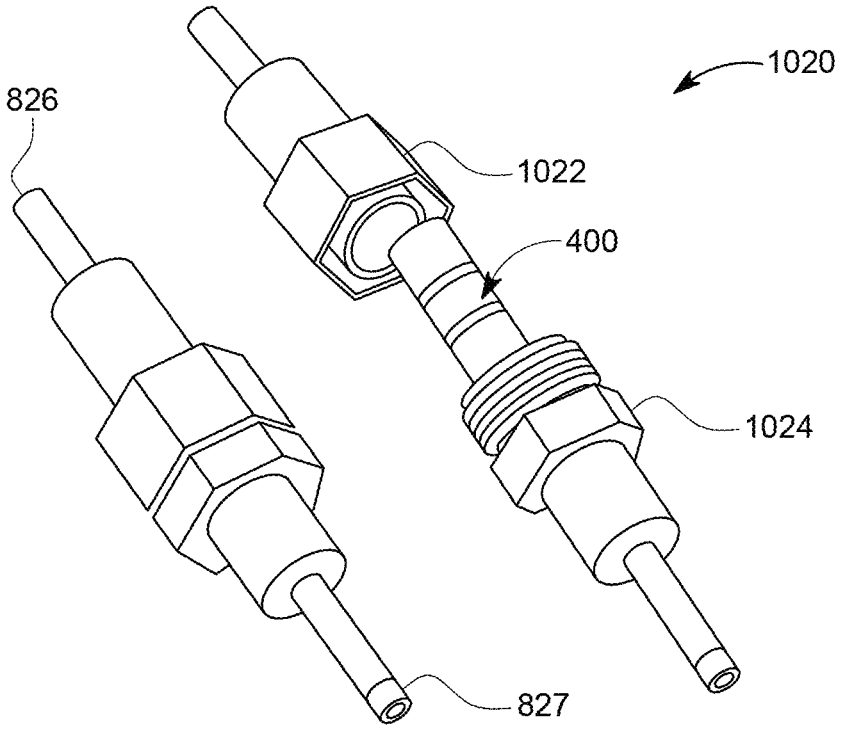
Figure 10C:
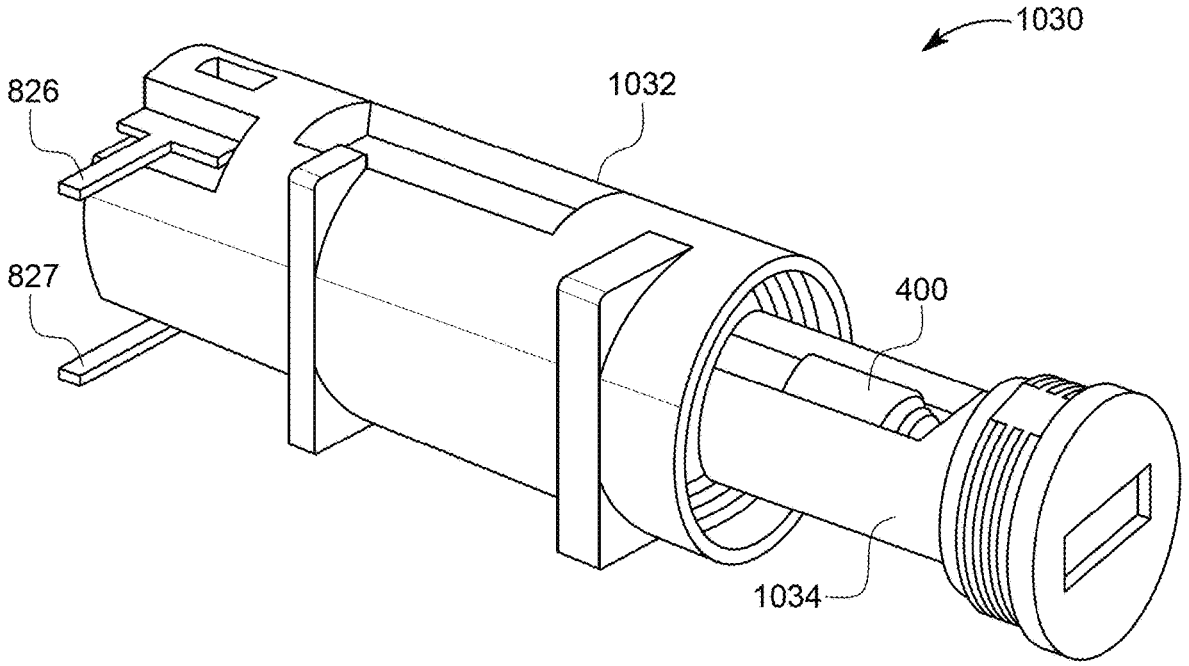
Figure 10D:
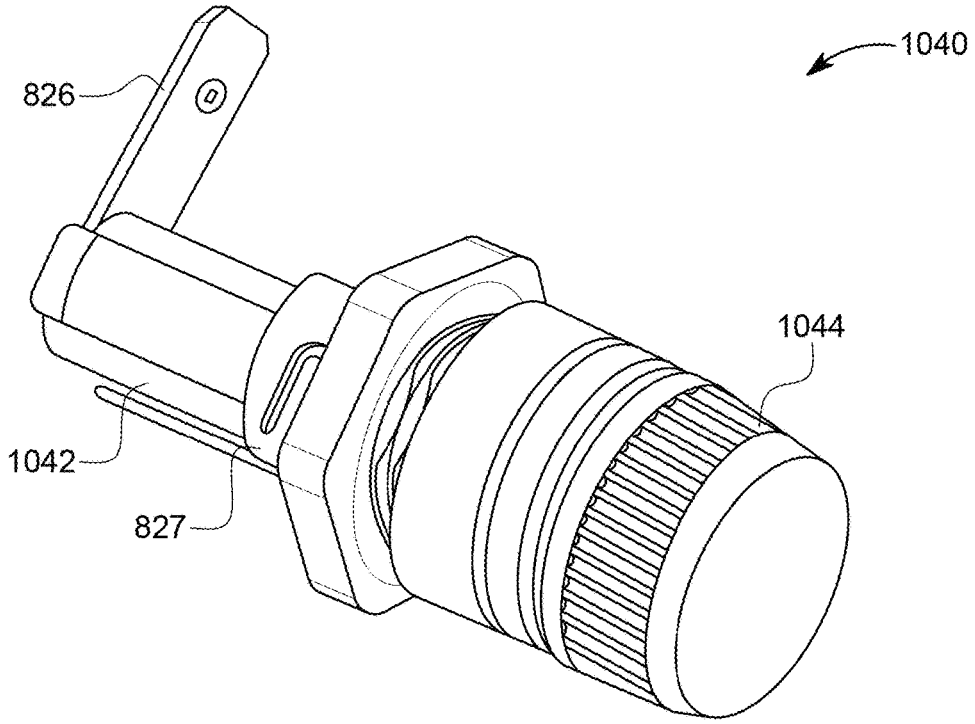

For example, FIG. 10A shows a single block clip 1010 that can be attached to the board 902. The block clip 1010 is a unitary piece that includes the two clips 822 and 824. FIG. 10B shows an inline holder 1020 for the detonator 400. The inline holder 1020 has a female part 1022 and a male part 1024 that mate to each other. Each of these two parts have an interior chamber that is configured to receive the detonator 400. Electrical contacts inside the male and female part ensure electrical connections to the first and third portions of the casing 402. FIG. 10C shows a printed circuit board mounted holder 1030 that has a casing 1032 configured to receive a drawer type part 1034. The drawer-type part 1034 is configured to receive the detonator 400 and then to slide inside the casing 1032. In one embodiment, the drawer type part can be configured to screw inside the casing. Electrical contacts are provided on the drawer type part and/or the casing to ensure that the detonator 400 is connected to the leads 826 and 827. A similar arrangement is shown in FIG. 10D, where the holder 1040 has a casing 1042 configured to receive the detonator 400 and a cap 1044 is configured to secure the detonator inside the casing. Other systems for connecting the detonator to the board 902 may be used.

Figure 11:
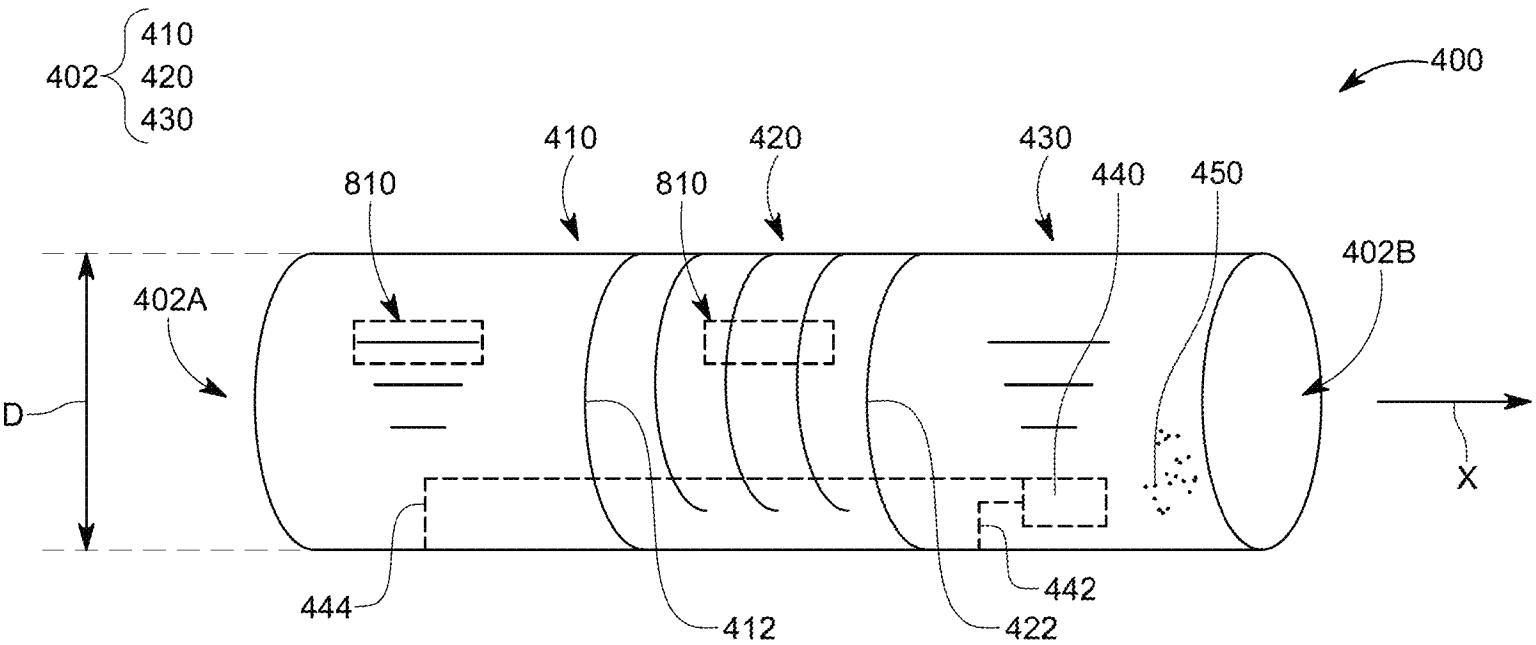
FIG. 11 illustrates another implementation of the one-click contact detonator so that a switch is part of the detonator.

While the embodiments discussed until now with regard to FIGS. 5 to 9 shown the switch being located external to the detonator 400, it is also possible to have the switch 810 integrated into the initiator 440 as illustrated in FIG. 11. The switch 810 can be located within the second portion 420 or the first portion 410. In one embodiment, each of the initiator 440 and the switch 810 are fully located within a corresponding portion of the casing 402. While it is preferably to have the initiator 440 and the switch 810 located in different portions of the casing 402, it is also possible to have both elements fully located within a single portion of the casing. In one application, either one of the initiator and the switch or both of them may be located to be partially extend in two adjacent portions of the casing.

Figure 12:
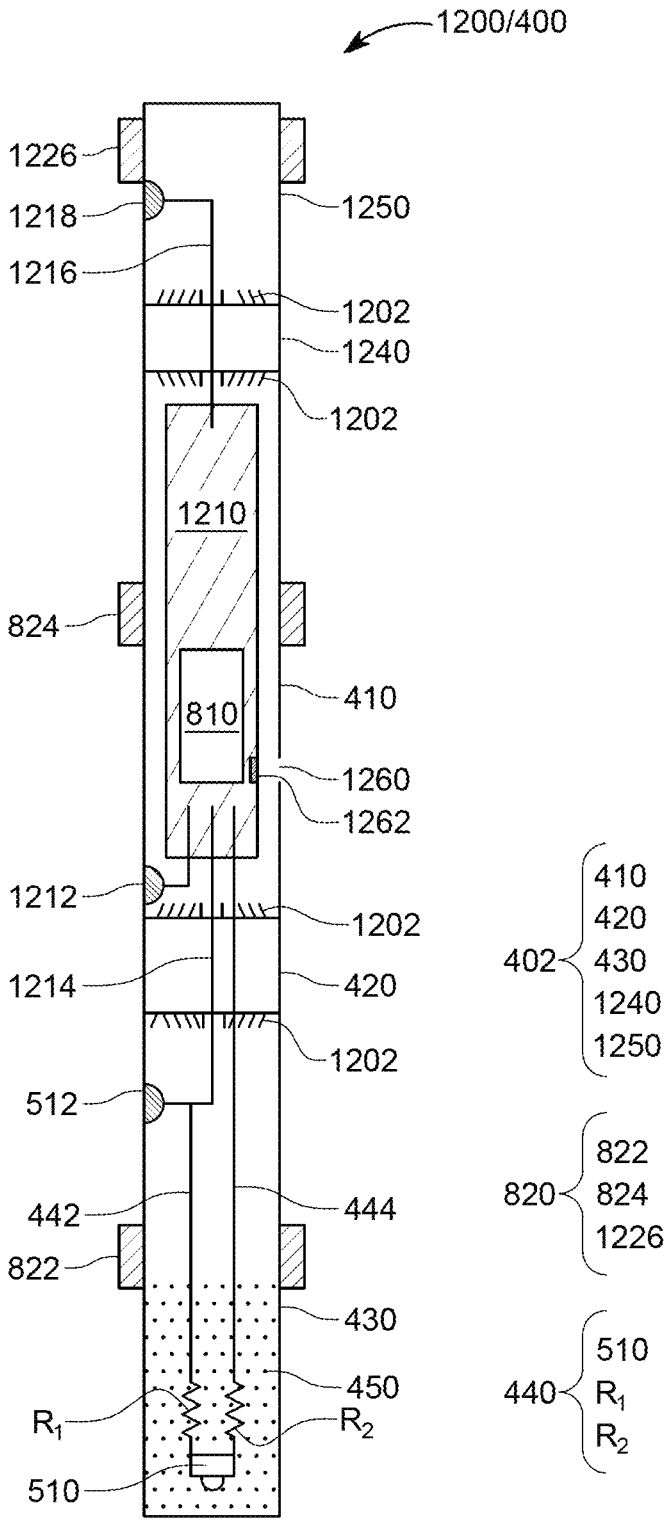
FIG. 12 illustrates an implementation of the one-click contact detonator that includes a casing having five different portions.

FIG. 12 shows one possible implementation 1200 of the detonator 400 in which the housing 402 has five different portions. FIG. 12 shows that in addition to the first to third portions 410 to 430, there is a fourth insulating portion 1240 directly attached to the third conductive portion 410, and a fifth conductive portion 1250 directly attached to the fourth insulating portion 1240. Note that these portions may be manufactured independent of each other and then attached to each other by crimping, as suggested by 1202. For this configuration, the third portion 430 holds the explosive material 450, and the initiator 440. Note that the initiator 440 is shown in the figure to have the configuration introduced in FIG. 5. However, the initiator 440 may have any other configuration, for example, the one shown in FIG. 6.

For the configuration shown in the figure, the first electrical line 442 is still connected to the electrical contact 512, similar to the configuration of FIG. 5, but the second electrical line 444 now extends to the third portion 420, where the switch 810 is housed, and connects to the switch 810 and not to the wall of the portion as in FIG. 5. The switch 810 can have any of the configurations discussed herein. The switch 810 is shown in this configuration being attached to a printed circuit board 1210. Further electronics may be attached to the printed circuit board 1210, for example, a power source, communication module, etc. The printed circuit board 1210 is electrically and/or directly connected to second electrical line 444. The board 1210 is also electrically connected to an electrical contact 1212, which is directly attached to an internal wall of the first conducting portion 410. Thus, the second electrical line 444, similar to the configuration shown in FIG. 5, fully extends through the second portion 420 and enters into the first portion 410. Different from the configuration shown in FIG. 5, the electrical contact 512 is electrically connected to the printed circuit board 1210, through a third electrical line 1214, that also extends from the third portion 430, through the second portion 420, and into the first portion 410, as shown in the figure.

The printed circuit board 1210 is also electrically connected, though a fourth electrical line 1216 to an electrical contact 1218, which is located on an internal wall of the fifth conductive portion 1250. Thus, for the configuration shown in FIG. 12, three different clips 822, 824, and 1226 or similar devices can be used to provide mechanical support for the detonator 400, and also for providing three different electrical connections, one clip for each conductive portion 430, 410, and 1250. While the first clip 822 can provide a ground, the second clip 824 can provide power/communication out and the third clip 1226 can provide power/communication in capabilities. It is noted that in one embodiment, only two clips may be used, in which case one of the clips 824 and 1226 may be used only to provide mechanical support. In one application, the implementation 1200 of the detonator 400 may be used with only two clips, for example, clips 822 and 824, although there are three conductive portions of the casing 402. In another application, a hole 1260 may be formed into the first portion 410 so that if any fluid enters inside the gun system, and that fluid arrives at the detonator 400, it can enter through the hole 1260 and interacts with a cut-off sensor 1262, that is located on the board 1210. The cut-off sensor 1262 is configured to disconnect the initiator 440 from the switch 810, to prevent the initiator's detonation when the fluid has penetrated the gun system.

Figure 13:
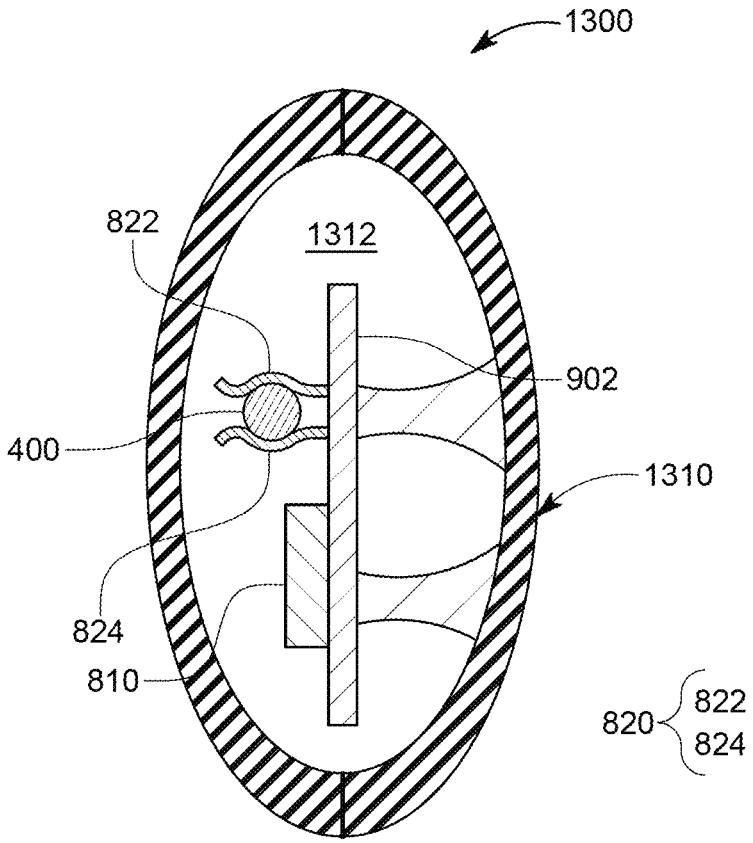
FIG. 13 illustrates a detonator assembly that is configured to hold the one-click contact detonator.
Figure 14A:
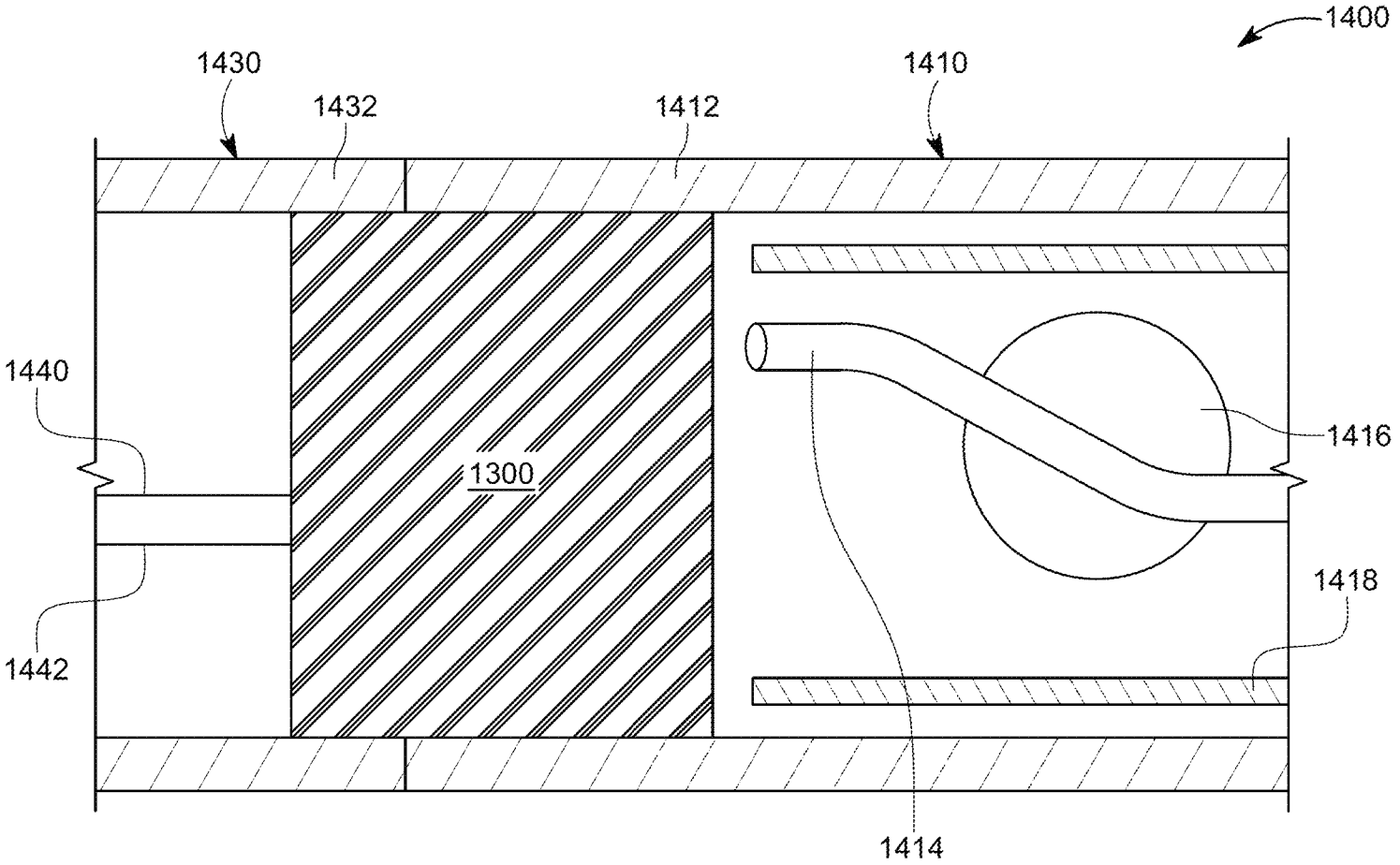
FIGS. 14A to 14C show various implementations of the one-click contact detonator within a gun system.
Figure 14B:
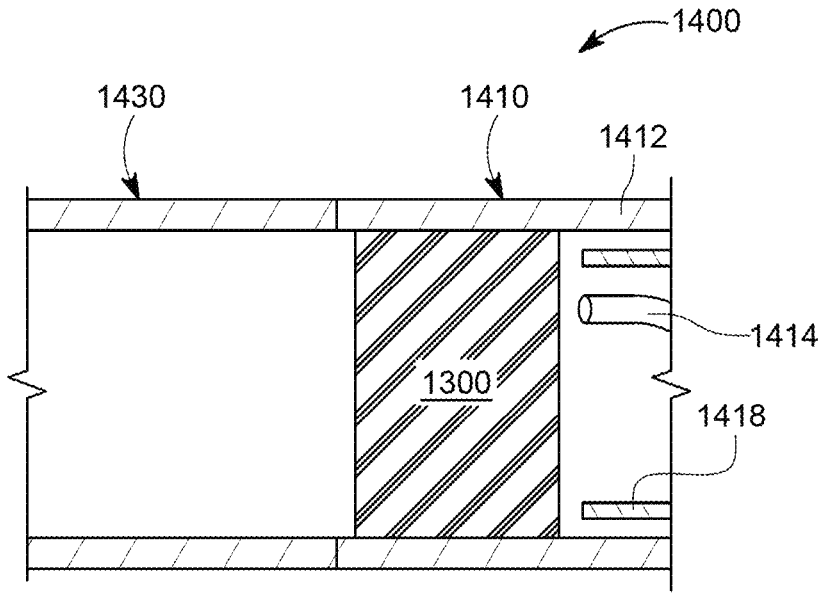
Figure 14C:
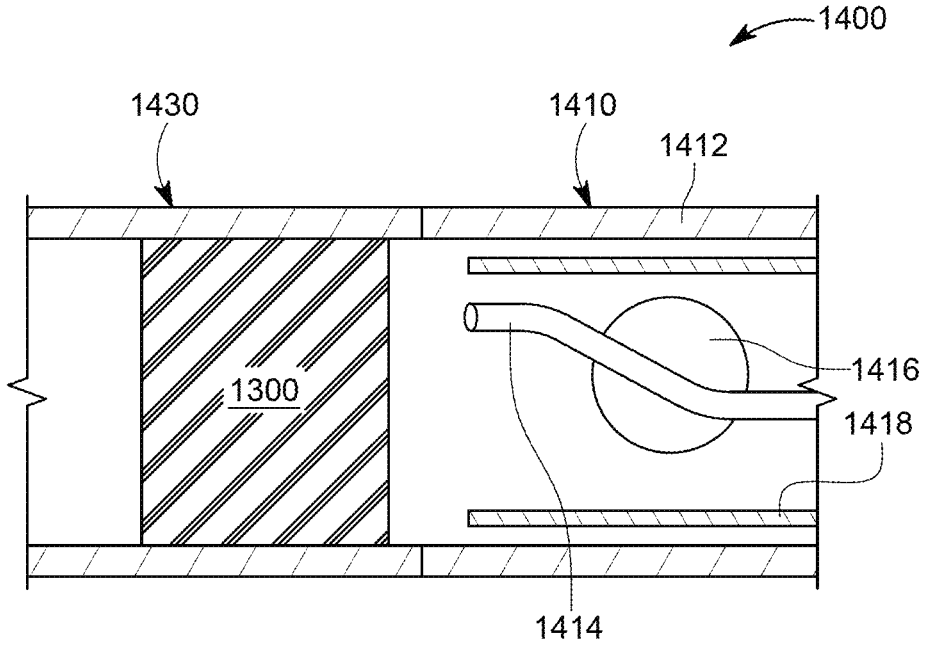

The detonator 400 can be attached to a sub or a gun or a detonator assembly in a gun system as now discussed. For example, FIG. 13 shows a detonator assembly 1300 that includes a shell 1310, formed for example from an insulator material. The shell may be circular, or oval, or may have other profiles in cross-section. The shell 1310 defines an inner chamber 1312 that hosts the printed circuit board 902, to which the connecting mechanism 820 is attached. The connecting mechanism 820 mechanically holds the detonator 400 and ensures at least two electrical connections to the board 902. The board 902 also holds the switch 810. In one embodiment, the detonator assembly 1300 is configured to enter, partially or totally, inside the housing 1412 of a gun 1410, as shown in FIG. 14A. The housing 1412 may be configured to hold a detonator cord 1414. The detonator cord 1414 may be wrapped around a carrier 1418 that holds one or more shaped charges 1416. The switch 810 is connected to one conductor 1440 or two conductors 1440 and 1442 to a next gun (not shown) or to a wireline (not shown). When the switch 810 of the detonator assembly 1300 receives commands to fire the detonator 400, along the conductors 1440 and/or 1442, the switch 810 activates the initiator 440 (see FIG. 4), which ignites the loading explosive 450. The fire power from the loading explosive 450 ignites the detonator cord 1414, which in turn fires the shaped charged 1416, thus forming one or more channels through the housing 1412 of the gun 1410. While the detonator assembly 1300 is shown in FIG. 14A placed partially into the housing 1412 of the gun 1410 and partially into the housing 1432 of the sub 1430, it is also possible to place the detonator assembly 1300 entirely into the sub 1430, or into the housing 1412 of the gun 1410, as shown in FIGS. 14B and 14C, respectively. Note that the sub 1430 and the gun 1410 form a gun system 1400. The gun system 1400 can have many guns 1410.

Figure 15:
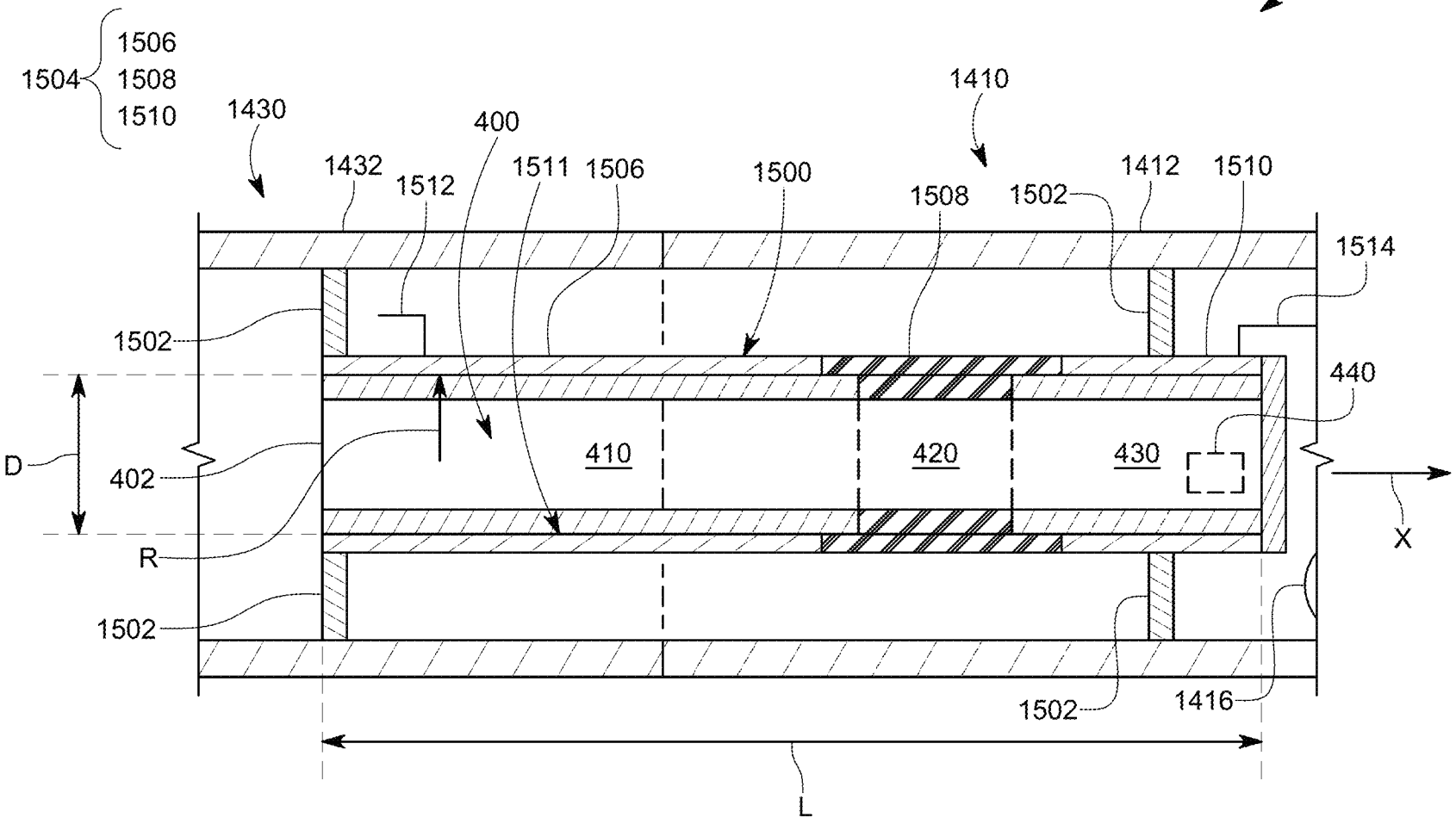
FIG. 15 illustrates the one-click contact detonator mating with a receiving mechanism that mimics the configuration of the housing of the detonator.

In one embodiment, as illustrated in FIG. 15, it is possible to slide the detonator 400 into a receiving mechanism 1500, which may be located entirely within the gun 1410, the sub 1430, or in both of these two elements. The receiving mechanism 1500 may be fixed with one or more brackets or wings 1502 to an interior wall of the gun, sub, or both of them. The receiving mechanism 1500 has a housing 1504 that extends longitudinally. The housing 1504 is formed of as many parts as the detonator 400 is made. For example, in the embodiment illustrated in FIG. 15, the detonator 400 is shaped as a cylinder having a unique radius R along the entire length L along the longitudinal axis X. The cylinder has three portions 410 to 430 and thus, the housing 1504 has three corresponding portions 1506, 1508, and 1510 and a bore 1511 that matches the cylinder shaped detonator 400. The first portion 1506 is made of a conductor material so that an electrical connection is achieved with the first portion 410 of the detonator 400. The second portion 1508 is made of an insulator so that no electrical connection can be established with the first or third portions 410 and 430 of the detonator 400. In this respect, note that the second portion 1508 of the receiving mechanism 1500 is longer than the second portion 420 of the detonator 400 so that the second portion 1508 of the receiving mechanism 1500 fully encloses the second portion 420 of the detonator 400, and partially encloses the first and third portions of the detonator. The third portion 1510 of the receiving mechanism 1500 is made of a conductor material so that an electrical connection is achieved with the third portion 430 of the detonator 400. Two wires 1512 and 1514 are electrically connected to the first and third portions of the receiving mechanism 1500 and they are configured to carry power and/or commands through the well. In this way, electrical signals can be transmitted through the wireline or from another sub or gun to the detonator 400. Note that in this embodiment the conducting parts 1506 and 1510 of the receiving mechanism 1500 act as the connecting mechanism 820, and there is no circuit board involved for holding the detonator 400. While the detonator 400 shown in FIG. 15 has the implementation shown in FIG. 5, any of the other implementations discussed herein for the detonator may be used with the receiving mechanism 1500. Also note that in one embodiment, the interior diameter D (=2R, where R is the external radius of the detonator) of the receiving mechanism 1500 is uniform and constant, and matches the external diameter of the detonator 400, within a given tolerance.

Figure 16:
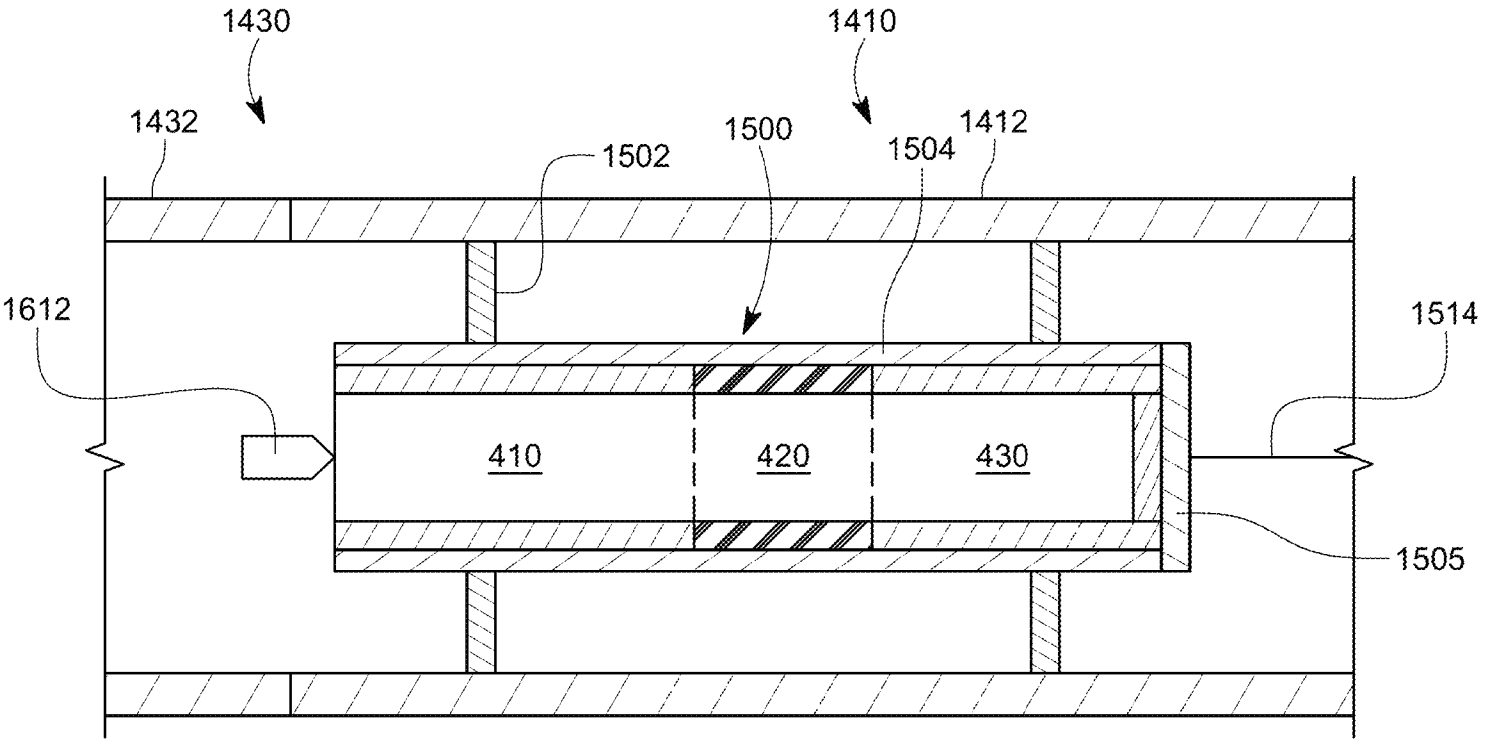
FIG. 16 illustrates a variation of the one-click contact detonator and the receiving mechanism of FIG. 15.

In another embodiment, as illustrated in FIG. 16, the entire casing 1504 of the receiving mechanism 1500 is made of an insulator, except for one end face 1505, which is made of a conducting material. The wire 1514 is directly connected to the end face 1505 for achieving an electrical contact with the third portion 430 of the detonator 400 and the other wire 1512 may be replaced by a pin 1612, which is biased to directly press on the end side of the first portion 410 of the detonator 400, for achieving an electrical connection. In this way, only the end faces of the detonator 400 are used for electrical connections. The pin 1612 may be part of the sub 1432.

A method for making the detonator 400 is now discussed. The various portions 410 to 430 of the detonator 400 can be manufactured independent of each other. The initiator 440 is inserted into the third portion 430 and the first electrical line 442 is attached to the internal wall of the casing. Then, the third portion 430 is filled with the explosive material 450 so that the initiator 440 is partially or totally embedded into the explosive material. The second portion 420 is added to the third portion 430, either by screwing, press-fitting, pushing, or crimping (or other known methods) and the second electrical line 444 is extended outside the second portion. Then, a filler material may be added to hold the second electrical line 444 in place, centered to the second portion. In one embodiment, it is possible to 3D print the second portion over the third portion and around the second electrical line 444. The first portion 410 is then added to the second portion, again by screwing, press-fitting, pushing, or crimping, and the end of the second electrical line is attached to the internal wall of the first portion. Then, a final cap may be added to the first portion to close the inside of the detonator 400. Other methods may be used to achieved the same detonator.

Figure 17A:
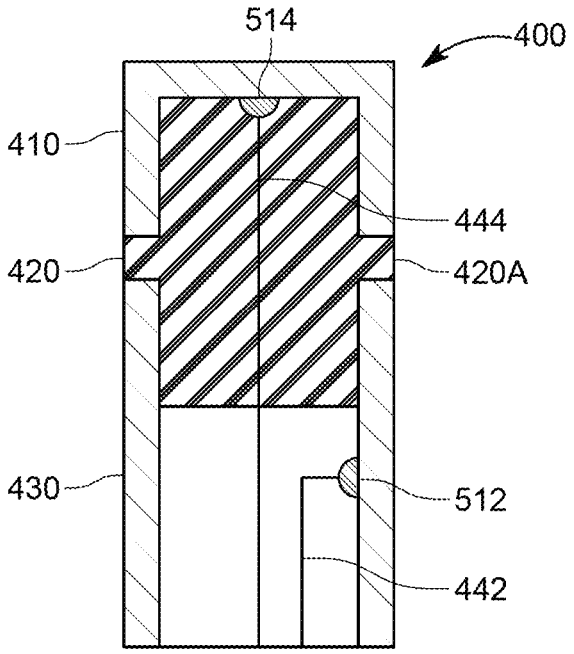
FIGS. 17A and 17B illustrate various ways to assembly the one-click contact detonator.
Figure 17B:
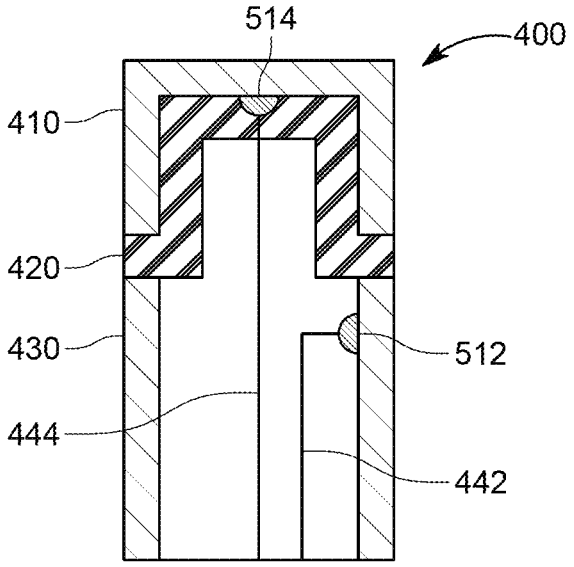

For example, as shown in FIG. 17A, it is possible to have the second insulating portion 420 made to mainly extend inside the bore of the first and third conducting portions 410 and 430, and only a small external part 420A to be flush with the external sides of the first and third portions. The electrical contact 514 in this case is housed within the second portion 420 but directly touches the first portion 410. A variation of this configuration is shown in FIG. 17B, wherein both the second portion 420 and the third portion 430 extend into the bore of the first portion 410 while the third portion 430 also extends into the bore of the second portion 420. Again, the external, visible, sides of the three portions are flush to each other as shown in the figure. For both of these embodiments, the assembly of the third portion goes similar to the method discussed above. Then, the second portion is forced into or over the third portion, and finally the first portion slides over the second portion. In this embodiment, the three portions stay together only due to the friction between them. Alternatively, a gluing substance may be placed between the three portions to hold them together.

Figure 18:
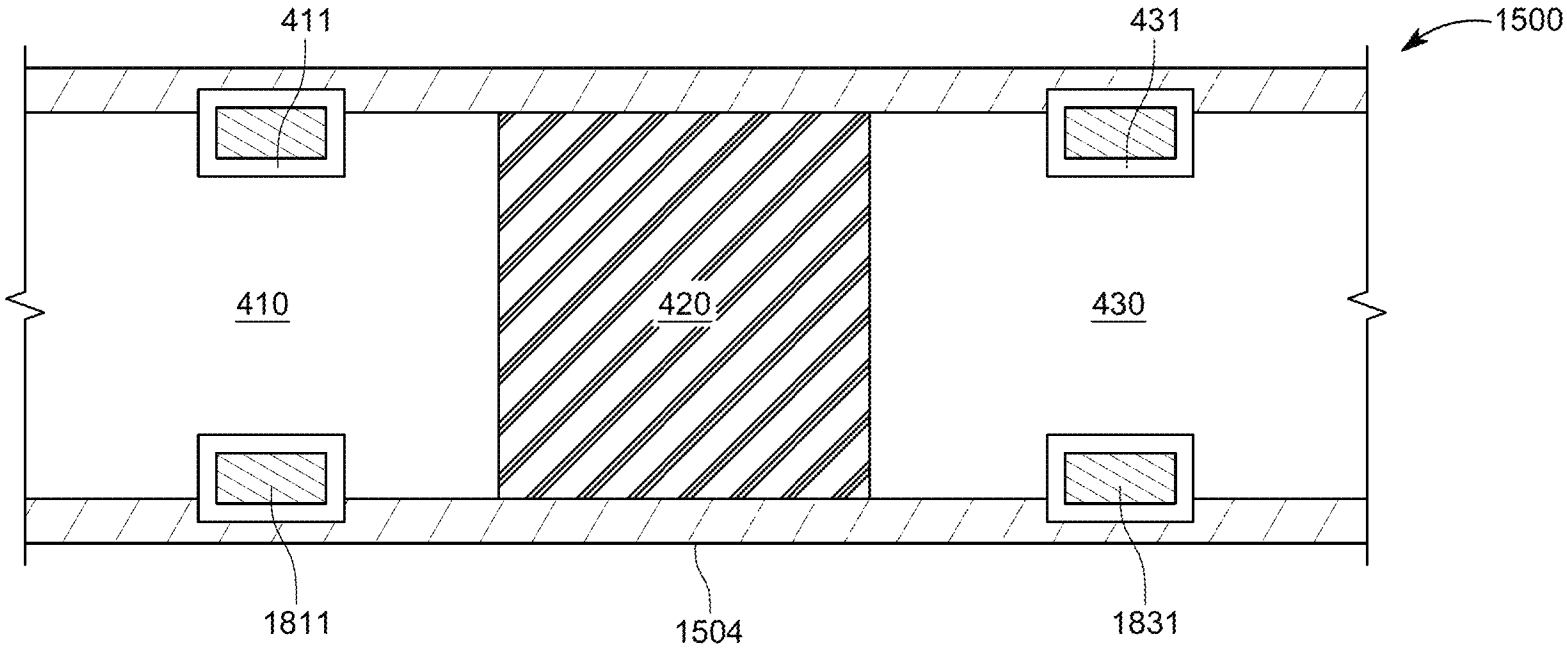
FIG. 18 illustrates still another way of connecting the one-click contact detonator to a corresponding receiving mechanism.

The detonator 400 discussed in the previous embodiments can be seen as a cartridge (like a cigar) having no external contacts attached or connected to the casing 402. The electrical contacts are the various parts of the casing, e.g., first portion 410 and third portion 430 in FIG. 4. The actual electrical connections with other components of the gun system are achieved either through the lateral sides of the cartridge, or through the end sides or through a mixture of them. If more than two electrical connections are required, more than three portions are used for the casing 402. In some embodiments, the detonator 400 is physically attached with a connecting mechanism 820 to a printed circuit board or other components of the gun system. The connecting mechanism 820 ensures not only a mechanical connection of the detonator 400 to the gun system, but also an electrical connection between the two. In some embodiments, the detonator 400 slides into a receiving mechanism 1500 and by virtue of the receiving mechanism mimicking the conductor/insulator/conductor structure of casing of the detonator, electrical connections between the two elements are obtained. Note that no clips or similar mechanical elements are necessary for the embodiment illustrated in FIG. 15. In fact, for this embodiment, as illustrated in FIG. 18, a groove 411 may be formed in the first portion 410 and a groove 431 may be formed in the third portion 430 of the detonator 400. The grooves may fully encircle the corresponding portions. Corresponding tongues or rings 1811 and 1831 are added to the receiving mechanism 1500, so that the rings fit into the grooves. In this way, the groove and ring mechanism not only mechanically fixes the detonator 400 to the receiving mechanism 1500, but also ensures electrical connections through the rings 1811 and 1831. To prevent the ring 1831 to be caught by the groove 411, their dimensions are made to be different.

The disclosed embodiments provide detonators for firing one or more shaped charges in a gun system and the detonators have a uniform and constant external shape. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A detonator for initiating a firing of a shaped charge in a gun, the detonator comprising:

a housing having first and third conducting portions and a second insulating portion, which is sandwiched between the first and third conducting portions;

an initiator located fully inside the first conducting portion;

a first electrical line electrically connecting the initiator to an internal wall of the first conducting portion; and a second electrical line electrically extending from the initiator to the third conducting portion, through the entire second insulating portion.

2. The detonator of claim 1, wherein an external diameter of each of the first to third portions is the same.

3. The detonator of claim 1, wherein external walls of the first to third portions are flush to each other.

4. The detonator of claim 1, wherein there is no electrical contact or wire that extends perpendicularly from a longitudinal axis of the housing.

5. The detonator of claim 1, wherein the housing is shaped as a cylinder and each of the first to third portions are shaped as cylinders.

6. The detonator of claim 1, wherein the initiator is surrounded by an explosive load.

7. The detonator of claim 1, wherein the first conducting portion is directly connected to the second insulating portion, and the second insulating portion is directly connected to the third conducting portion.

8. The detonator of claim 1, further comprising:

a fourth insulating region directly connected to the first conducting portion; and a fifth conducting region directly connected to the fourth insulating region.

9. The detonator of claim 8, further comprising:

a printed circuit board located within the first conducting region; and a switch attached to the printed circuit board and configured to actuate the initiator.

10. The detonator of claim 9, wherein the second electrical line is electrically connected to the printed circuit board.

11. The detonator of claim 10, wherein the first electrical line is electrically connected to the printed circuit board.

12. The detonator of claim 11, wherein the printed circuit board is further electrically connected, through a third electrical line, to an interior wall of the fifth conducting portion.

13. A detonator assembly for initiating a firing of a shaped charge in a gun, the detonator assembly comprising:

a shell;

a board located within the shell;

a one-click connecting mechanism attached to the board;

a detonator comprising:

a housing having first and third conducting portions and a second insulating portion, which is sandwiched between the first and third conducting portions;

an initiator located fully inside the first conducting portion;

a first electrical line electrically connecting the initiator to an internal wall of the first conducting portion; and a second electrical line electrically extending from the initiator to the third conducting portion, through the entire second insulating portion; and a switch located on the board, wherein the connecting mechanism is configured to removably receive the detonator, and wherein the connecting mechanism establishes electrical connections between the detonator and the board.

14. The detonator assembly of claim 13, wherein the connecting mechanism includes plural clips configured to hold the detonator.

15. The detonator assembly of claim 13, wherein external walls of the first to third portions are flush to each other.

16. The detonator assembly of claim 13, wherein the housing is shaped as a cylinder and each of the first to third portions are shaped as cylinders that share a same external diameter.

17. A gun system for perforating a well, the gun system comprising:

a gun having one or more shaped charges;

a detonator having a length L and comprising:

a cylindrical housing having:

a unique radius R along the entire length L;

first and third conducting portions; and a second insulating portion, which is sandwiched between the first and third conducting portions;

an initiator located fully inside the first conducting portion;

a first electrical line electrically connecting the initiator to an internal wall of the first conducting portion; and a second electrical line electrically extending from the initiator to the third conducting portion, through the entire second insulating portion; and a receiving mechanism having a bore that is configured to receive the detonator.

18. The gun system of claim 17, wherein the detonator is configured to fully slide inside the bore of the receiving mechanism.

19. The gun system of claim 17, further comprising:

a sub that is connected to the gun, wherein the receiving mechanism is fully located within the gun.

* * * * *